United States Patent [19]

Hopmann

[11] Patent Number: 4,909,325

[45] Date of Patent: Mar. 20, 1990

[54] HORIZONTAL WELL TURBULIZER AND METHOD

[75] Inventor: Mark E. Hopmann, Broken Arrow, Okla.

[73] Assignee: Baker Hughes Incorporated, Houston, Tex.

[21] Appl. No.: 309,825

[22] Filed: Feb. 9, 1989

[51] Int. Cl.[4] ..... E21B 21/00; E21B 37/00; B08B 9/02

[52] U.S. Cl. ..... 166/312; 166/173; 166/223; 166/373; 15/104.12; 134/22.12; 134/24; 134/167 C

[58] Field of Search ..... 166/311, 312, 170, 173, 166/222, 223, 373, 374, 386, 318, 332; 15/104.061, 104.05, 109.09, 104.12; 175/107; 134/22.12, 24, 32, 33, 167 C, 172, 191, 198

[56] References Cited

U.S. PATENT DOCUMENTS

| | | | |
|---|---|---|---|
| 2,336,293 | 12/1943 | Pietcher | 15/104.12 |
| 2,735,794 | 9/1956 | Pletcher | 15/104.12 |
| 2,785,875 | 3/1957 | Hayes | 166/223 |
| 3,547,191 | 12/1970 | Malott | 166/223 |
| 3,844,362 | 10/1974 | Elbert et al. | 166/223 |
| 4,031,971 | 6/1977 | Miller | 15/104.12 |
| 4,037,661 | 7/1977 | Ford | 166/223 |
| 4,442,899 | 4/1984 | Zublin | 166/222 |
| 4,518,041 | 5/1985 | Zublin | 166/222 |
| 4,705,107 | 11/1987 | Counsil et al. | 15/104.12 |
| 4,744,420 | 5/1988 | Patterson et al. | 166/312 |

*Primary Examiner*—Bruce M. Kisliuk

*Attorney, Agent, or Firm*—Hubbard, Thurman, Turner & Tucker

[57] ABSTRACT

The invention provides a method and apparatus for securement onto one end of a continuous length of remedial tubing which is introduced into a subterranean well concentrically through production tubing previously positioned within the well, with the well having a deviated configuration which includes an entry portion communicating with a curved portion extending downwardly in the well from the entry portion and a generally linear end portion traversable with a production formation. The apparatus includes a cylindrical housing and an element for securement of the housing to the tubing. A fluid passageway chamber is defined exterior of the housing with fluid passageways communicating between the interior of the housing and the expansion chamber. Turbulating elements are carried exteriorly around the housing and immediate the expansion chamber and are freely rotatable relative to the housing. A series of fluid compression ports are radially disposed through the sleeve, whereby fluid flow from the top of the well through the remedial tubing in excess of a pre-determinable pressure will be transmitted through the housing, the passage-ways and into the compression chamber. The fluid may be thereafter injected through the compression ports to activate rotary motion of the sleeve and turbulize the fluid for washing action within the linear end portion of the well.

8 Claims, 2 Drawing Sheets

HORIZONTAL WELL TURBULIZER AND METHOD

BACKGROUND OF THE INVENTION (1) Field of the Invention:

The present invention is directed to a horizontal well turbulizer and method, wherein particulate matter disposed within a generally linear end portion of said well, which is of a generally horizontal configuration, may be placed into suspension within fluid for removal to the top of the well.

(2) Description of the Prior Art:

In the past, those skilled in the art relating to remedial operations associated with the drilling, production and completion of subterranean oil and gas wells have relied on conventional "snubbing" or hydraulic workover units which utilize threaded or coupled remedial tubing normally inserted through production tubing for use in operations, such as perforating, acidizing and fracturing, corrosion control, pressure testing of tubular goods and vessels, cementing, clean out operations, sand bridge removal, storm valve recovery, insertion of kill strings, wireline tool fishing, and the like.

Continuous coiled remedial tubing and injectors for use therewith have contributed substantially to conventional remedial tubing operations. For example, coil tubing, being continuous, can be inserted into the well faster than threaded and coupled tubing which is furnished in relatively short sections that must be screwed together. In addition, it is easier, when required, to pass continuous tubing through stuffing boxes and blowout preventers because its external diameter is consistently the same size and not interrupted periodically by couplings. The coiled remedial tubing normally is made of steel and is commercially available in sizes from 0.75 inch o.d. through 1.315 inch o.d., but may have a smaller or larger diameter. Typical of such remedial coil tubing and injectors is that generally described in U.S. Pat. No. 3,182,877. The apparatus is commercially referred to as the "Bowen Continuous Spring Tubing Injector Unit" and basically comprises a hydraulically powered injector unit which feeds a continuous remedial tubing string from a coiled or "spooled" workstring contained on a powered and generally portable reel unit into the wellhead by means of two opposed, endless, rotating traction members. Such a reel unit is generally described in U.S. Pat. No. 3,614,019. The upper end of the string which remains on the reel is conventionally connected to the hollow shaft of the reel which permits a liquid or a gas to be pumped through the coiled remedial tubing string by means of a swivel connection. The injector and reel are normally mounted on a single transportable skid, a trailer, or, alternatively, may be componently arranged on skids to facilitate convenient offshore use.

To inject remedial coiled tubing, the injector is arranged on or above the wellhead. The reel unit, containing up to approximately 15,000 feet of continuous coiled metal remedial tubing, is located preferably about 15 to 20 feet from the wellhead. The remedial coiled tubing is brought from the reel in a smooth arc loop through the injector unit and into the well through pressure retention and control equipment.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation. Most production formations have a substantial horizontal portions and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be redrilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear well-bore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In such deviated well bores, particularly those having the longer lengths, fracturing fluids can be expected to be introduced into the linear, or horizontal, end portion of the well to frac the production zone to open up production fissures and pores therethrough. Such action will result in particulate matter flowing into the wellbore, particularly from top to bottom, through perforations within the casing, such that it will become difficult, if not impossible to laterally move devices through the production tubing which are required for certain completion operations in such linear or horizontal end portion of such wells. Because of the horizontal nature of such linear end portions of such wells, such material can be expected to gravitate, collect, and compact, particularly on the downward-most side and within the production tubing. It would then be desirable to first break up such compaction by providing a suspension of such particulate matter within the washing, or other, fluid, and thereafter circulate such suspended particulate matter to the top of the well, for removal.

The present invention provides a method and apparatus for providing a turbulizing washing action for such compacted particulate matter within a horizontal or generally linear end portion of a subterranean well.

SUMMARY OF THE INVENTION

The present invention is directed to a method and apparatus for providing a turbulizing washing apparatus for a horizontal well. The apparatus is secured onto one end of a continuous length of remedial tubing which is introduceable into the subterranean well and which is concentrically insertable through production tubing previously positioned within the well, the well having a deviated configuration including an entry portion communicating with a curved portion extending downwardly in the well from the entry portion, and a generally linear end portion traversable with a production formation. The apparatus comprises a cylindrical housing. Means at one end of the housing are provided for securement to the end of the remedial tubing. A fluid expansion chamber is defined exterior of the housing and fluid passageways communicate between the interior of the cylindrical housing and the expansion chamber. A turbulating sleeve means are carried exteriorly around the housing and immediate the expansion chamber and are freely rotatable relative to the housing. A series of fluid compression ports are radially disposed through the sleeve means, whereby fluid flow from the top of the well through the remedial tubing in excess of a pre-determinable pressure will be transmitted through the housing, the passage-ways, and into the compression chamber, and the fluid may be thereafter injected through the fluid compression ports to activate rotary motion of the sleeve and turbulize the fluid for washing action within the linear end portion of the well.

In a preferred format, the apparatus also includes a frontal conically shaped nose member on the housing with fluid ejection passageways through the nose member communicating with the interior of the housing. Port means are carried on the nose and extend to the outboard end of the passageways whereby pressurized fluid transmitted through the remedial tubing and the housing will be ejected through the nose to wash the particulate matter within the linear end portion away from and ahead of the apparatus. In another preferred embodiment, the ejection passageways are angularly offset one from another to direct the action of the fluid frontal and above and frontal and below the apparatus within the linear end portion, and the fluid compression ports are angularly offset 90° relative to the fluid passageways.

DESCRIPTION OF THE PREFERRED EMBODIMENTS

Figure 1:
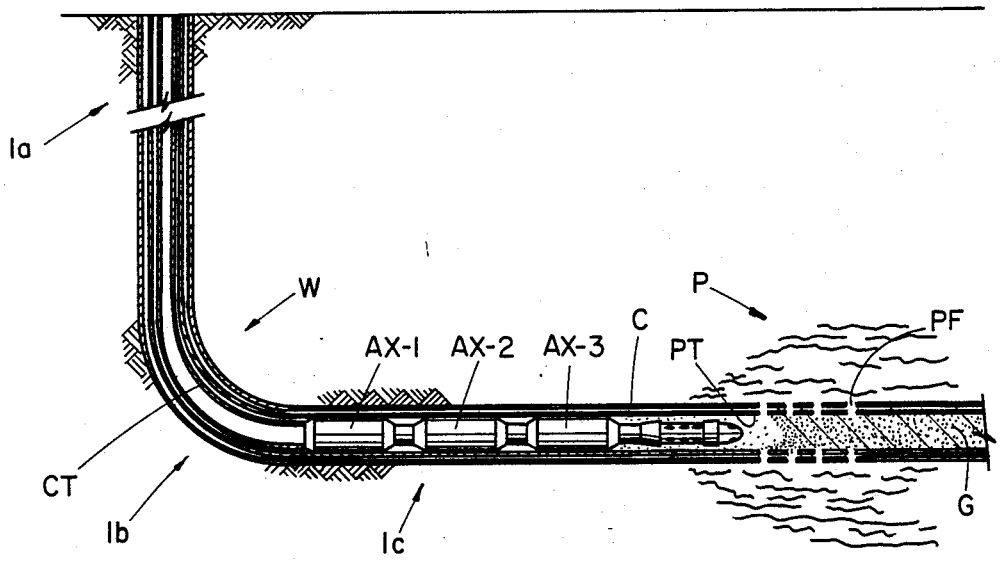
FIG. 1 is a schematic sectional illustration of a horizontal completion of a subterranean well with a device of the present invention inserted through production tubing and carried on remedial tubing.

Now with reference to FIG. 1, there is shown a deviated wellbore W of the type for which this invention is useful. Such wellbore W comprises a vertical entry section 1*a* communicating through a relatively short radius curvature portion 1*b* with a non-vertical or horizontal portion 1*c* communicating with the production formation P with perforations PF disposed through a casing conduit C carried exteriorly of production tubing PT. In most instances, the production formation P extends for a substantial horizontal extent and the generally linear wellbore portion 1*c* traverses a substantial horizontal extent of the producton formation, at least up to a distance of 1000 to 2000 feet or more. The radius portion 1*b* of the wellbore W has a curvature of at least 10° per 100 feet of length and preferably a curvature lying in the range of 10° to 30° per 100 feet of length. A casing C has been previously inserted in the wellbore W and perforated as shown at PF, within the linear non-vertical or horizontal portion 1*c* traversing the production formation P. Particulate matter G is shown being compactedly deposited within the interior of the casing C around the production tubing PT and ahead of the apparatus 10 which is carried within the wellbore W on remedial tubing CT inserted through the uppermost end thereof.

Figure 3:
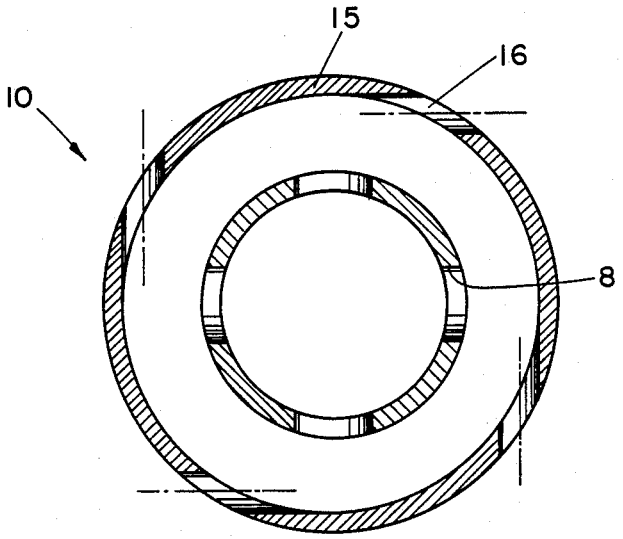
FIG. 3 is a cross-sectional view looking downwardly along line 3—3 of FIG. 2.
Figure 2:
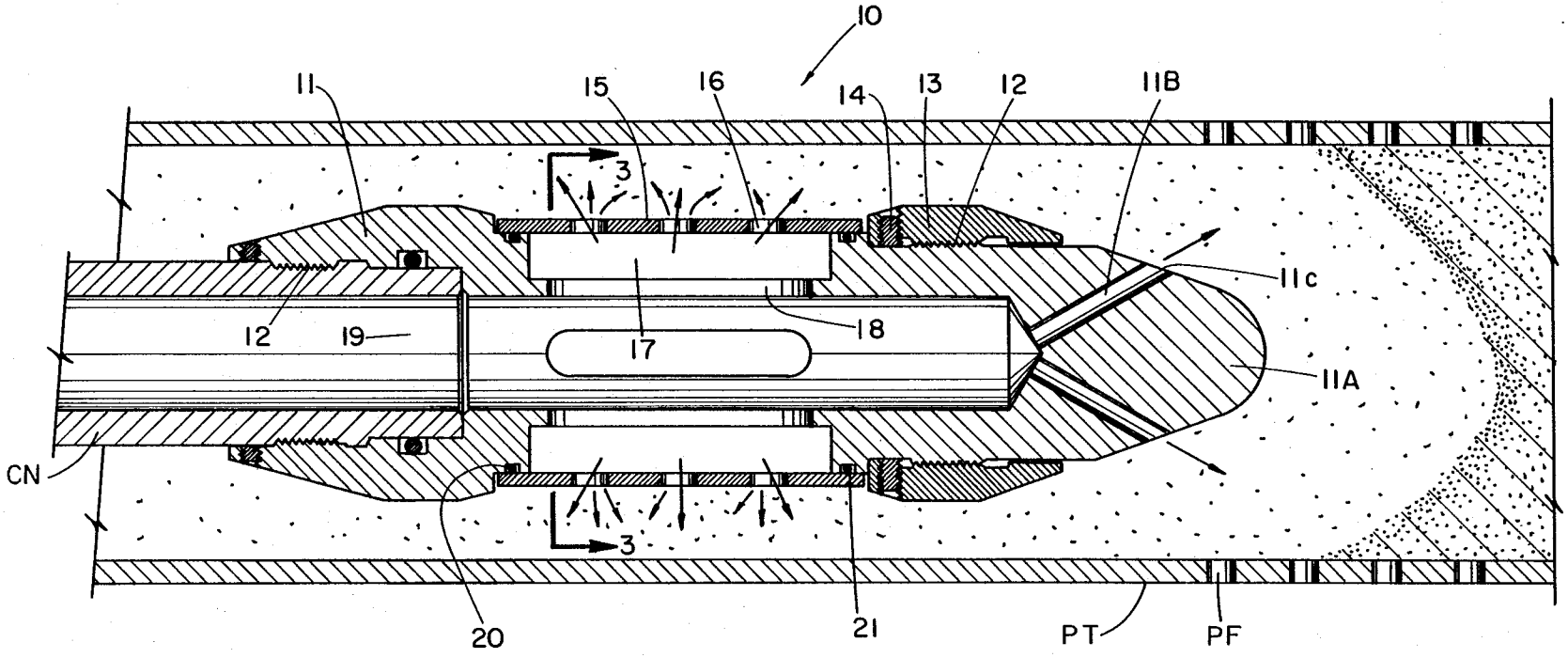
FIG. 2 is a longitudinal sectional drawing showing the apparatus with pressurized fluid flow therethrough for turbulizing action and rotary motion of said sleeve means to wash said particulate matter.

Now referring to FIGS. 2 and 3, there is shown an apparatus 10 having a generally cylindrical housing 11 with means, i.e. threads 12, at one end of the housing 11 for carryable securement relative to one end of said remedial tubing CT. Of course, it will be appreciated that the apparatus 10 may be directly secured to one end of the remedial tubing, but, typically, such tubing CT will carry within the well additional apparatuses, AX-1, AX-2 and AX-3 (FIG. 1), such as shifting devices for sliding sleeves, valve members, and the like, with the apparatus 10 being indirectly affixed to the end of the continuous remedial tubing CT at the lowermost end of such tubing CT and said auxiliary devices. A circumferentially extending elastomeric O-ring seal member is carried within the housing 11 to prevent fluid communication between the housing 11 and a connector CN extending from the apparatus 10 by means of the housing 11 to either the remedial tubing CT, or to an auxiliary apparatus carried above said apparatus 10.

Exterior of the apparatus 10 and carried adjacent its lowermost end is a donut-like sleeve element 13 secured exteriorly around the housing 11 by means of threads 12 and set screw 14, the outer diameter of the sleeve 13 being greater than the outer diameter of a turbulating sleeve means 15 carried circumferentially around the exterior of the housing 11 thereabove. It should also be noted that the uppermost end of the housing 11 above the turbulating sleeve means 15 has an outer diameter in excess of that of the turbulating sleeve means 15 to afford protection thereof and to assure that rotary action, described below of the tubulating sleeve means 15 is not interfered with by contact and resistance action of the apparatus 10 within the interior of the production tubing PT.

The turbulating sleeve means is cylindrical in nature and has thereon a series of radially extending fluid compression ports 16 communicating between the exterior of the apparatus 10 and a fluid expansion chamber 17 defined between the exterior of the housing 11 and the interior of the turbulating sleeve means 15. The fluid expansion chamber 17 communicates with the hollow interior 19 of the apparatus 10 by means of circumferentially emplaced fluid passageways 18.

Elastomeric seal elements 20, 21 are placed on the housing 11 to communicate with the uppermost and lowermost ends, respectively, of the turbulating sleeve means 15. Such members 20, 21 may be formed of a hard elastomer, or a metallic-like substance to combine the features of fluid flow prevention and bearing surfaces.

The housing 11 has defined at its outboard-most end a frontal conically shaped nose member 11*a* having fluid ejection passageways 11*b* extending therein and being in communication with the interior 19 of the apparatus 10, the passageways 11*b* having port means 11*c* at the outboard-most end of the fluid passageways 11*b* for ejection of washing fluid through the apparatus 10 by means of the hollow interior 10, thence through the passageway 11*b* and out the ports 11*c*. The ports 11*c* are angularly positioned within the nose member 11*a* such that they eject washing fluid thereout in a flow form along the top and bottom of the production tubing PT within the generally linear end section of the subterranean well W. In such fashion, the fluid ejection passageways 11*b* in concert with the ports 11*c* are angularly offset one from another to direct the action of the washing fluid frontal and above and frontal and below the apparatus 10 within the generally linear end portion of the well W.

The ports 16 through the sleeve 15 are angularly offset 90° relative to the passageways 18 within the housing 11, but such degree of angular offset may be somewhat varied depending upon the desired turbulating effect of the injection fluid through the remedial tubing CT.

OPERATION

It will be assumed that the well W has been fractured or, alternatively, drilled through a horizontal section of production P which produces sand with the production fluids, and such particulate matter from such fracturing operation, or as a result of perforations being placed through the casing C, results in compacted particulate material being deposited particularly around the bottom of the interior of the casing C and production tubing PT within the horizontal section of the well W. It is desired to break such compacted material up and suspend same into a washing fluid, or other treatment fluid, to remove same from the well.

Accordingly, the apparatus 10 as shown in FIG. 2 is inserted either directly on the lowermost end of the remedial continuous tubing RT, or, alternatively, is implaced for carriage into the well on the remedial tubing CT along with other apparatuses, such as AX-1, AX-2 and AX-3, as discussed earlier. The tool is affixed, as described, and inserted into the well and positioned just ahead of the compacted particulate matter within the horizontal section of the subterranean well. The pressure within fluid introduced through the remedial tubing RT is increased. If such fluid has not been introduced into the remedial tubing previously, it is now transmitted to pass through the interior 19 of the apparatus 10 through the remedial tubing CT at a pressure in excess of a pre-determinable pressure.

As such fluid pressure and flow increases, such fluid passes through the passageways 18 and into the expansion chamber 17. Fluid flow resistance then is effected by the reduced diameter of the ports 16 within the sleeve 15 such that such ports 16 cause such fluid to be compressed and such compression energy is transmitted into rotary turbulizing action of the sleeve 15 relative to the housing 11. As the sleeve 15 rotates at a considerably high rpm rate, such as 1000 rpm, or greater, such fluid will come into contact with a compacted particulate matter PM within the interior of the well W horizontal section and break away and disperse same into suspension within the fluid exterior of the apparatus 11. Now, such particulate matter may be circulated along with the fluid passing exteriorly of the apparatus 10 and within the interior of the production tubing 10, as such fluid is continuously pumped to the top of the well in the annular area defined as the exterior of the remedial tubing CT and the interior of the production tubing PT. Alternatively, a cleaning fluid may be introduced downwardly through the production tubing PT casing C annulus for passage through the interior of the production tubing PT adjacent the horizontal section of the subterranean well W for carriage to the top of the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. Apparatus for securement onto one end of a continuous length of remedial tubing introduceable into a subterranean well and concentrically insertable through production tubing previously positioned within said well, said well having a deviated configuration including an entry portion communicating with a curved portion extending downwardly in the well from said entry portion, and a generally linear end portion traversable with a production formation, said apparatus comprising:

(1) a cylindrical housing;

(2) means at one end of said housing for carryable securement relative to said one end of said remedial tubing;

(3) a fluid expansion chamber exterior of said housing;

(4) fluid passageways communicating between the interior of said cylindrical housing and said expansion chamber;

(5) turbulating sleeve means carried exteriorly around said housing and immediate said expansion chamber and freely rotatable relative to said housing;

(6) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;

(7) a frontal conically shaped nose member on said housing;

(8) fluid ejection passageways through said conically shaped nose member communicating with the interior of said housing; and (9) port means on said nose and extending to the out board end of said fluid ejection passageways whereby pressurized fluid transmitted through said remedial tubing and said housing will be ejected through said nose to wash particulate matter within said linear end portion away from and ahead of said apparatus.

2. The apparatus of claim 1:

said fluid ejection passageways being angularly offset one from another to direct the action of said fluid frontal and above and frontal and below said apparatus within said linear end portion.

3. Method of washing contaminant particulate matter within the linear end portion of a subterranean well, said well having a deviated configuration including an entry portion communicating with a curved portion extending downwardly in the well from said entry portion and a generally linear end portion traversable with a production formation, comprising the steps of:

(1) securing onto one end of a continuous length of remedial tubing introduceable into said subterranean well concentrically through production tubing previously positioned within said well, an apparatus having:
(a) a cylindrical housing;
(b) means at one end of said housing for carryable securement relative to said one end of said remedial tubing;
(c) a fluid expansion chamber exterior of said housing;
(d) fluid passageways communicating between the interior of said cylindrical housing and said expansion chamber;
(e) turbulating sleeve means carried exteriorly around said housing and immediate said expansion chamber and freely rotatable relative to said housing;
(f) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;
(g) a frontal conically shaped nose member on said housing;
(h) fluid ejection passageways through said conically shaped nose member communicating with the interior of said housing; and
(i) port means on said nose and extending to the outboard end of said passageways whereby pressurized fluid transmitted through said remedial tubing and said housing will be ejected through said nose to wash particulate matter within said linear end portion away from and ahead of said apparatus;

(2) inserting said continuous remedial tubing with said apparatus secured thereon into said well to position said apparatus immediate the generally linear end portion of said well;

(3) introducing a washing fluid through said remedial tubing and said apparatus in excess of a predeterminable pressure; and (4) transmitting said pressured washing fluid through said expansion chamber and said fluid compression ports to actuate said sleeve means into rotary motion relative to said housing and turbulize said fluid to wash said contaminant particulate matter away from said apparatus to thereby form a suspension of said particulate matter within fluid exterior of said apparatus and said tubing for subsequent removal to the top of the well.

4. Method of washing contaminant particulate matter within the linear end portion of a subterranean well, said well having a deviated configuration including an entry portion communicating with a curved portion extending downwardly in the well from said entry portion and a generally linear end portion traversable with a production formation, comprising the steps of:

(1) securing onto one end of a continuous length of remedial tubing introduceable into said subterranean well concentrically through production tubing previously positioned within said well, and apparatus having:
(a) a cylindrical housing;
(b) means at one end of said housing for carryable securement relative to said one end of said remedial tubing;
(c) a fluid expansion chamber exterior of said housing;
(d) fluid passageways communicating between the interior of said cylindrical housing and said expansion chamber;
(e) turbulating sleeve means carried exteriorly around said housing and immediate said expansion chamber and freely rotatable relative to said housing;
(f) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;
(g) a frontal conically shaped nose member on said housing;
(h) fluid ejection passageways through said conically shaped nose member communicating with the interior of said housing;
(i) port means on said nose and extending to the outboard end of said passageways whereby pressurized fluid transmitted through said remedial tubing and said housing will be ejected through said nose to wash particulate matter within said linear end portion away from and ahead of said apparatus; and
(j) said fluid ejection passageways being angularly offset one from another to direct the action of said fluid frontal and above and frontal and below said apparatus within said linear end portion;

(2) inserting said continuous remedial tubing with said apparatus secured thereon into said well to position said apparatus immediate the generally linear end portion of said well;

(3) introducing a washing fluid through said remedial tubing and said apparatus in excess of a predeterminable pressure; and (4) transmitting said pressured washing fluid through said expansion chamber and said fluid compression ports to actuate said sleeve means into rotary motion relative to said housing and turbulize said fluid to wash said contaminant particulate matter away from said apparatus to thereby form a suspension of said particulate matter within fluid exterior of said apparatus and said tubing for subsequent removal to the top of the well.

5. Method of washing contaminant particulate matter within the linear end portion of a subterranean well, said well having a deviated configuration including an entry portion communicating with a curved portion extending downwardly in the well from said entry portion and a generally linear end portion traversable with a production formation, comprising the steps of:

(1) securing onto one end of a continuous length of remedial tubing introduceable into said subterranean well concentrically through production tubing previously positioned within said well, an apparatus having:

(a) a cylindrical housing;

(b) means at one end of said housing for carryable securement relative to said one end of said remedial tubing;

(c) a fluid expansion chamber exterior of said housing;

(d) fluid passageways communicating between the interior of said cylindrical housing and said expansion chamber;

(e) turbulating sleeve means carried exteriorly around said housing and immediate said expansion chamber and freely rotatable relative to said housing; and (f) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;

(2) inserting said continuous remedial tubing with said apparatus secured thereon into said well to position said apparatus immediate the generally linear end portion of said well;

(3) introducing a washing fluid through said remedial tubing and said apparatus in excess of a predeterminable pressure;

(4) transmitting said pressured washing fluid through said expansion chamber and said fluid compression ports to actuate said sleeve means into rotary motion relative to said housing and turbulize said fluid to wash said contaminant particulate matter away from said apparatus to thereby form a suspension of said particulate matter within fluid exterior of said apparatus and said tubing for subsequent removal to the top of the well; and (5) introducing fluid into said well and exterior of said production tubing and passing said fluid through the interior of said production tubing at the lowermost end of said production tubing within said generally linear end portion of said well and carrying said suspended particulate matter therewith to the top of the well interiorly of said production tubing and exteriorly of said remedial tubing.

6. Method of washing contaminant particulate matter within the linear end portion of a subterranean well, said well having a deviated configuration including an entry portion communicating with a curved portion extending downwardly in the well from said entry portion and a generally linear end portion traversable with a production formation, comprising the steps of:

(1) securing onto one end of a continuous length of remedial tubing introduceable into said subterranean well concentrically through production tubing previously positioned within said well, an apparatus having:

(a) a cylindrical housing;

(b) means at one end of said housing for carryable securement relative to said one end of said remedial tubing;

(c) a fluid expansion chamber exterior of said housing;

(d) fluid passageways communicating between the interior of said cylindrical housing and said expansion chamber;

(e) turbulating sleeve means carried exteriorly around said housing and immediate said expansion chamber and freely rotatable relative to said housing;

(f) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;

(g) a frontal conically shaped nose member on said housing;

(h) fluid ejection passageways through said conically shaped nose member communicating with the interior of said housing; and (i) port means on said nose and extending to the outboard end of said passageways whereby pressurized fluid transmitted through said remedial tubing and said housing will be ejected through said nose to wash particulate matter within said linear end portion away from and ahead of said apparatus;

(2) inserting said continuous remedial tubing with said apparatus secured thereon into said well to position said apparatus immediate the generally linear end portion of said well;

(3) introducing a washing fluid through said remedial tubing and said apparatus in excess of a predeterminable pressure;

(4) transmitting said pressured washing fluid through said expansion chamber and said fluid compression ports to actuate said sleeve means into rotary motion relative to said housing and turbulize said fluid to wash said contaminant particulate matter away from said apparatus to thereby form a suspension of said particulate matter within fluid exterior of said apparatus and said tubing for subsequent removal to the top of the well; and (5) introducing fluid into said well and exterior of said production tubing and passing said fluid through the interior of said production tubing at the lowermost end of said production tubing within said generally linear end portion of said well and carrying said suspended particulate matter therewith to the top of the well interiorly of said production tubing and exteriorly of said remedial tubing.

7. Method of washing contaminant particulate matter within the linear end portion of a subterranean well, said well having a deviated configuration including an entry portion communicating with a curved portion extending downwardly in the well from said entry portion and a generally linear end portion traversable with a production formation, comprising the steps of:

(1) securing onto one end of a continuous length of remedial tubing introduceable into said subterranean well concentrically through production tubing previously positioned within said well, an apparatus having:

(a) a cylindrical housing;

(b) means at one end of said housing for carryable securement relative to said one end of said remedial tubing;

(c) a fluid expansion chamber exterior of said housing;

(d) fluid passageways communicating between the interior of said cylindrical housing and said expansion chamber;

(e) turbulating sleeve means carried exteriorly around said housing and immediate said expansion chamber and freely rotatable relative to said housing;

(f) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;

(g) a frontal conically shaped nose member on said housing;

(h) fluid ejection passageways through said conically shaped nose member communicating with the interior of said housing;

(i) port means on said nose and extending to the outboard end of said passageways whereby pressurized fluid transmitted through said remedial tubing and said housing will be ejected through said nose to wash particulate matter within said linear end portion away from and ahead of said apparatus; and (j) said fluid ejection passageways being angularly offset one from another to direct the action of said fluid frontal and above and frontal and below said apparatus within said linear end portion;

(2) inserting said continuous remedial tubing with said apparatus secured thereon into said well to position said apparatus immediate the generally linear end portion of said well;

(3) introducing a washing fluid through said remedial tubing and said apparatus in excess of a predeterminable pressure;

(4) transmitting said pressured washing fluid through said expansion chamber and said fluid compression ports to actuate said sleeve means into rotary motion relative to said housing and turbulize said fluid to wash said contaminant particulate matter away from said apparatus to thereby form a suspension of said particulate matter within fluid exterior of said apparatus and said tubing for subsequent removal to the top of the well; and (5) introducing fluid into said well and exterior of said production tubing and passing said fluid through the interior of said production tubing at the lowermost end of said production tubing within said generally linear end portion of said well and carrying said suspended particulate matter therewith to the top of the well interiorly of said production tubing and exteriorly of said remedial tubing.

8. Method of washing contaminant particulate matter within the linear end portion of a subterranean well, said well having a deviated configuration including an entry portion communicating with a curved portion extending downwardly in the well from said entry portion and a generally linear end portion traversable with a production formation, comprising the steps of:

(1) securing onto one end of a continuous length of remedial tubing introduceable into said subterranean well concentrically through production tubing previously positioned within said well, an apparatus having:

(a) a cylindrical housing;

(b) means at one end of said housing for carryable securement relative to said one end of said remedial tubing;

(c) a fluid expansion chamber exterior of said housing;

(d) fluid passageways communicating between the interior of said cylindrical housing and said expansion chamber;

(e) turbulating sleeve means carried exteriorly around said housing and immediate said expansion chamber and freely rotatable relative to said housing;

(f) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;

(g) a frontal conically shaped nose member on said housing;

(h) fluid ejection passageways through said conically shaped nose member communicating with the interior of said housing;

(i) port means on said nose and extending to the outboard end of said passageways whereby pressurized fluid transmitted through said remedial tubing and said housing will be ejected through said nose to wash particulate matter within said linear end portion away from and ahead of said apparatus; and (j) said fluid ejection passageways being angularly offset one from another to direct the action of said fluid frontal and above and frontal and below said apparatus within said linear end portion, said fluid compression ports being angularly offset 90° relative to said fluid passageways;

(2) inserting said continuous remedial tubing with said apparatus secured thereon into said well to position said apparatus immediate the generally linear end portion of said well;

(3) introducing a washing fluid through said remedial tubing and said apparatus in excess of a predeterminable pressure;

(4) transmitting said pressured washing fluid through said expansion chamber and said fluid compression ports to actuate said sleeve means into rotary motion relative to said housing and turbulize said fluid to wash said contaminant particulate matter away from said apparatus to thereby form a suspension of said particulate matter within fluid exterior of said apparatus and said tubing for subsequent removal to the top of the well; and (5) introducing fluid into said well and exterior of said production tubing and passing said fluid through the interior of said production tubing at the lowermost end of said production tubing within said generally linear end portion of said well and carrying said suspended particulate matter therewith to the top of the well interiorly of said production tubing and exteriorly of said remedial tubing.

* * * * *